US005797541A

United States Patent [19]

Stenner

[11] Patent Number: 5,797,541

[45] Date of Patent: Aug. 25, 1998

[54] DIRECT MAIL ARTICLE COMPRISING OVERSIZED CARD AND INTEGRAL ENVELOPE AND REPLY DEVICE AND METHOD OF MANUFACTURE

[75] Inventor: John W. Stenner, Orange, Conn.

[73] Assignee: Kurt H. Volk, Inc., Milford, Conn.

[21] Appl. No.: 449,345

[22] Filed: May 24, 1995

[51] Int. Cl.[6] ..... B65D 27/06

[52] U.S. Cl. ..... 229/92.8; 229/300

[58] Field of Search ..... 229/300, 301, 229/70, 92.1, 92.3, 92.7, 92.8

[56] References Cited

U.S. PATENT DOCUMENTS

| | | | |
|---|---|---|---|
| 520,816 | 6/1894 | Wallace | 229/92.1 |
| 967,406 | 8/1910 | Martin | 229/92.8 X |
| 1,043,243 | 11/1912 | Mitchell | 229/300 X |
| 1,736,588 | 11/1929 | Galter . | |
| 1,783,022 | 11/1930 | Little | 229/92.1 X |
| 1,870,909 | 8/1932 | Hoffmann . | |
| 2,069,602 | 2/1937 | Davis | 229/92.3 |
| 2,078,873 | 4/1937 | Binger . | |
| 3,229,893 | 1/1966 | Stein | 229/301 |
| 3,275,316 | 9/1966 | Cleary, Jr. | 229/301 X |
| 3,807,771 | 4/1974 | Greason | 229/301 X |
| 3,899,381 | 8/1975 | O'Brien et al. . | |
| 4,912,909 | 4/1990 | Stenner | 53/429 |
| 5,169,060 | 12/1992 | Tighe et al. . | |
| 5,340,017 | 8/1994 | Tighe . | |

FOREIGN PATENT DOCUMENTS

| | | | |
|---|---|---|---|
| 15215 | 11/1900 | United Kingdom . | |
| 28557 | 10/1912 | United Kingdom | 229/92.1 |

*Primary Examiner*—Jes F. Pascua
*Attorney, Agent, or Firm*—Abelman, Frayne & Schwab

[57] ABSTRACT

A direct mail article that is produced from an integral web or sheet of card stock that can be transmitted through the mails without an outer wrapper or envelope comprises a large or oversized card approximately the size of a book or magazine cover, a preformed reply envelope that is separably joined to the card directly or through an intermediate reply device panel that is separably joined to the envelope flap. The preformed reply envelope and reply device panel are folded to a superposed position on the card and secured to the card for mailing by releasable adhesive means. Alternatively, the direct mail article comprises a large card and a reply device panel, the reply device panel comprising at least one business reply card and at least one advertising panel, all of which are separably joined along transverse parting lines to each other and to the card and folded to a superposed position on the card where they are secured for mailing by releasable adhesive means.

11 Claims, 6 Drawing Sheets

FIG. 2A
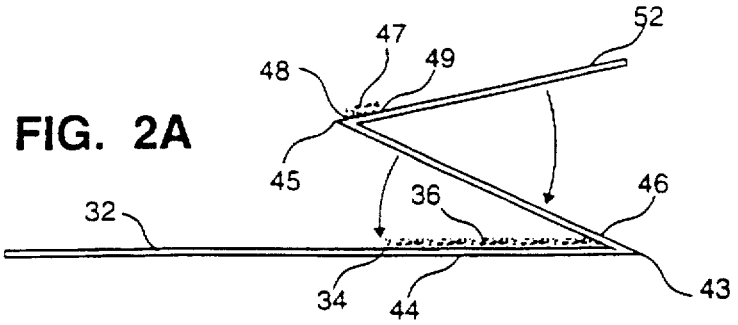
FIG. 2B
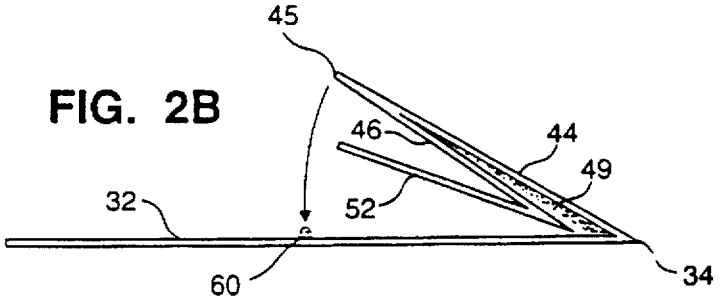
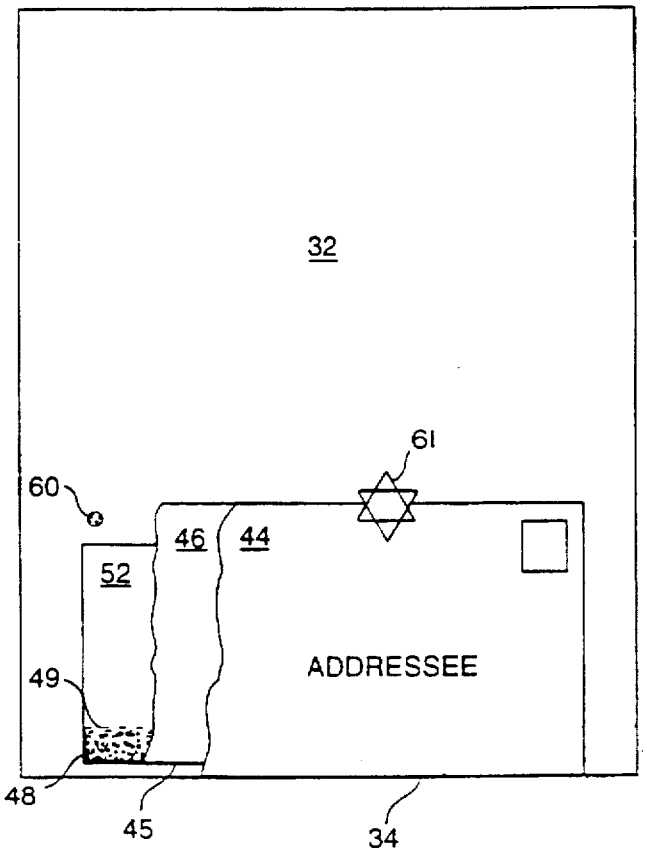
FIG. 3

DIRECT MAIL ARTICLE COMPRISING OVERSIZED CARD AND INTEGRAL ENVELOPE AND REPLY DEVICE AND METHOD OF MANUFACTURE

FIELD OF THE INVENTION

This invention relates to direct mail articles produced from self-mailable card stock requiring no outer wrapper or envelope.

BACKGROUND OF THE INVENTION

Direct mail articles requiring no outer wrapper or envelope must be produced on card stock of a weight that is sufficient to meet postal service requirements. For example, postal cards of various sizes, including picture postcards and cards containing printed advertising and solicitations have been produced on card stock meeting postal service requirements for mailing without an outer wrapper or envelope.

Magazine covers prepared from such card stock have been printed and perforated with separable return cards or other forms of reply devices for use by the recipient of the magazine. Of course, removal of the reply device damages the cover and reduces the archival value and utility of the publication. Solicitations and printed promotional literature has been printed on conventional paper, and double or extra thickness panels produced by folding and gluing two or more layers into superposed position, and thereafter cutting and/or perforating appropriate margins to provide a separable reply device in the nature of a postcard. The sheet or web containing the extra thickness panel must then be inserted, or itself formed into an envelope for mailing to the recipient.

In order to improve the favorable response rate from direct mail advertising and commercial solicitations, it is desirable to include a personalized reply device containing the original addressee's name and address, as well as encoded information, on a form that permits selection and confirmation of merchandise or services to be ordered, or for identification of contributors in the case of charitable solicitations. The reply device can take the form of a prepaid business reply postcard. Where a check or other payment order is to be returned with the reply device, it is desirable to also provide a postage prepaid and addressed return envelope that can be sealed by the original recipient.

It is therefore an object of this invention to provide a direct mail article in the form of a large or oversized card that is adapted to receive printed fields on one or both sides and an integral preformed reply envelope and reply device, all of which can be self-mailed without a separate outer wrapper or envelope.

It is another object of this invention to provide a direct mail article produced on heavy card stock that can be mailed without an outer wrapper or envelope, and that is in the form of a large card approximating the size and appearance of a magazine cover, along with an integral preformed business reply envelope and integral reply device, all of which can be easily separated by the recipient into three individual pieces.

It is a further object of this invention to provide a direct mail article that can be pre-printed and personalized in a plurality of positions while in the form of a continuous web or sheet and thereafter die-cut and folded into a resultant self-mailable card and readily separable preformed envelope and separable reply device that are temporarily secured in a superposed relation on the card for transmission through the mails to the recipient.

Another object of the invention is to provide a large printable card, approximating the size of a book or magazine cover, to which are separably attached one or more reply devices and one or more printable panels or sections for receiving advertising or informational copy, folded and assembled into a unit that can be mailed without an outer wrapper or cover.

It is yet another object of this invention to provide methods for economically producing a self-mailer in the form of a large or oversized card and integral therewith, one or more reply devices, and optionally, a reply envelope for use by the recipient, from a preprinted web or sheet that can be personalized in one or more fields on the self-mailer.

SUMMARY OF THE INVENTION

The above objects of the invention, and others, are met by a direct mail article produced from an integral web or sheet of card stock of sufficient weight to be transmitted through the mails without an outer wrapper or envelope that comprises a large or oversized card that can approximate the size of a magazine cover, a preformed reply envelope of conventional appearance that is separably joined to the card and having a sealable flap and a reply device separably joined to the envelope flap, the reply device being of a size adapted to fit within the envelope, the envelope and reply device being folded to a superposed position on the card and secured for mailing. The entire assembly comprising the separate elements can be printed and personalized in multiple positions within the printed field, for example, on one face of the reply card, on one side of the return envelope and at one or more positions on one or both sides of the oversized card.

In another embodiment of the invention, a direct mail article is produced from an integral web or sheet of card stock that comprises a large or oversized card that is separably joined to a reply device panel, where the reply device panel comprises one or more reply devices and one or more advertising devices, all of which are separably joined along transverse parting lines and that are folded to a superposed position on the card and secured for mailing.

In practicing the method of the invention, the pre-printed card stock in the form of a continuous web or sheet, comprises a card panel terminating along a first transverse parting line, an envelope panel joined to the card panel along the first transverse parting line and having a rear panel joined to a front panel along a first transverse fold line and a flap joined to the front panel along a second transverse fold line, and a reply device panel joined to the envelope flap along the second transverse parting line and terminating along a third transverse line, where the method comprises the steps of:

(a) cutting and removing at least one longitudinal edge of the reply device panel so that the reply device is narrower than the envelope panel, (b) applying adhesive to the longitudinal edges of at least one of the envelope rear panel and front panel, (c) perforating the first and second transverse parting lines, (d) folding the reply device along the second transverse fold line to contact the envelope front panel, (e) folding the envelope front panel onto the envelope rear panel along the first transverse fold line thereby bonding the longitudinal edges and forming the envelope pocket, (f) folding the envelope along the first transverse parting line to a superposed position on the card panel, and (g) applying releasable adhesive sealing means to temporarily bond the envelope and reply device to the card panel.

Following printing, the elements comprising the card, envelope and reply device are separated from the web or sheet, and thereafter subjected to die cutting, perforating, gluing and folding operations, as will be described in more detail below in connection with the method of the invention.

In its general configuration, the finished direct mail article comprises a reply device, such as a postcard, separably joined along the transverse edge of the envelope flap and folded into a position lying flat against the envelope, the envelope in turn folded along a transverse parting line by which it is separably joined to the card, and one or more spots of releasable adhesive to secure the envelope and attached reply device to the face of the card for transmission through the mails.

In a preferred embodiment, the edges of the preformed envelope and attached reply device lie inside the edges of the oversized card, i.e., the envelope is narrower than the card. This preferred configuration reduces the likelihood and opportunity that the edge of the envelope will be lifted away from the adjacent surface of the card. The transverse dimension of the reply device is less than the envelope pocket.

In a further preferred embodiment, the reply device, which is separably attached to the envelope flap does not cover the entire surface of the adjacent envelope panel. That is, the longitudinal dimension of the reply device and envelope flap is less than the longitudinal dimension of the envelope panel. When the assembly is folded, a narrow margin of the envelope is exposed for application of one or more spots of releasable adhesive to temporarily bond the edge of the envelope panel to the oversized card during transmission through the mail. Upon receipt, the recipient easily lifts the envelope from its superposed position against the card, and subsequently separates the envelope along a line of perforations from the card, and also separates the reply device along a second line of perforations that define the edge of the envelope flap.

In another embodiment of the invention, a plurality of reply devices or the like can be joined along transverse parting lines and folded into superposed position for transmittal through the mail.

In another variation of the invention, the panel of the envelope that is visible when the elements are secured for mailing can be personalized with the addressee information; the opposite envelope panel can be pre-printed with a return address and postage prepaid indicia for mailing of the reply device and/or payment.

An especially effective use of the direct mail article of the invention is as a solicitation for magazine subscriptions, where the card is printed with the same cover as a current edition of the magazine. The opposite side of the card can be printed with a reproduction of the table of contents of the magazine of an article, or other commentary selected from the same edition.

The oversized card can be used to print a reproduction in actual size of other types of materials, such as the dust covers for cookbooks, current best sellers and the like, or with replicas of documents such as health and life insurance policies that are customarily printed on letter sized sheets. Unlimited uses and applications will occur to those familiar with the art.

BRIEF DESCRIPTION OF THE DRAWINGS

These and other objects and advantages are attained by the means described herein and disclosed in the accompanying drawings in which:

FIG. 2A is a side view of the partially folded panels comprising the invention of FIG. 1 following separation from the sheet;

FIG. 2B show the further progression of the folding of the sheet from FIG. 2A;

FIG. 3 is a partial cutaway perspective view showing the finished article;

DETAILED DESCRIPTION OF THE INVENTION

Figure 1:
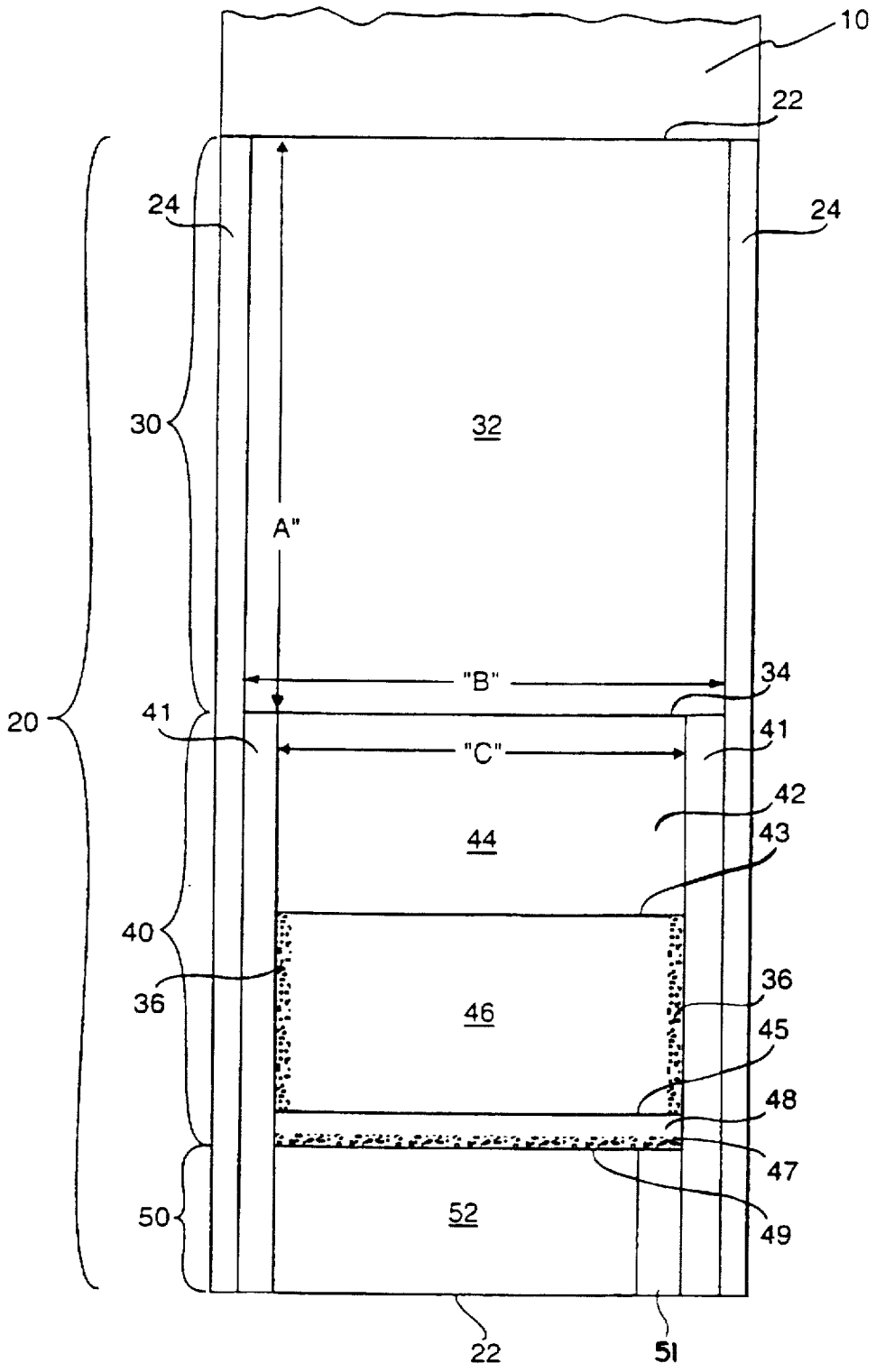
FIG. 1 is a plan view of a portion of a sheet or web illustrating the layout of one embodiment the invention in an unfolded form.

As shown in the plan view of FIG. 1, continuous web or sheet 10 illustrates the preliminary layout of a preferred embodiment of the invention. In the practice of the invention, the form 20 will have been pre-printed with the desired fields on its front and reverse sides, and optionally personalized. Form 20 is divided into card panel 30, envelope panel 40 and reply device panel 50. Card panel 30 is joined along first transverse parting line 34, which is preferably a line of perforations to facilitate subsequent folding and eventual separation of the card from the remaining elements. Envelope panel 40 comprises rear envelope panel 44 joined to front envelope panel 46 along first transverse fold line 43, and flap 48 joined to front panel 46 along second transverse fold line 45. Flap 48 terminates along third transverse line 22 and is preferably provided with a remoistenable adhesive 47. Reply device 52 is joined to flap 48 along second transverse parting line 49 which is preferably a perforated line to facilitate easy removal of the reply device 52 from flap 48 by the recipient.

The marginal edges of either or both of the rear and front envelope panels, 44, 46, are provided with a liquid or hot melt adhesive to bond the edges and form the envelope pocket in a subsequent folding step as described below.

In the preferred embodiment illustrated in FIG. 1, the marginal edge portions 24 of sheet 20 are removed following printing, as by die-cutting or guillotine trimming, to remove any machine markings and provide a finished appearance to the opposite edges of card 32.

Also as shown in the preferred embodiment of FIG. 1, the marginal edges 41 of the envelope panel 40 are removed, as by die-cutting, so that the width "C" of the finished envelope is less than the width "B" of card 32. With this configuration, the marginal edges of the envelope when subsequently folded into a superposed position on card 32 will lie within the outer or longitudinal edges of card 32, thereby reducing the opportunity for the envelope to be lifted from the surface of card 32 and damaged or inadvertently separated prior to delivery to the recipient.

Also as shown in FIG. 1, the marginal area 51 adjacent the longitudinal edge of reply device 52 is removed, as by die-cutting, so that the width of reply device 52 is less than of the envelope to thereby facilitate its eventual insertion into the finished envelope by the recipient. Where the reply device can also be used without the envelope, as when no payment is to be submitted, its minimum dimensions can be determined in accordance with the requirements of the postal service for such business reply postcards.

Following the die-cutting and trimming operations on form 20, the finished article is folded in accordance with the sequence illustrated in FIGS. 2A and 2B. Reply device 52 and flap 48 are folded along second transverse fold line 45 to a position over front envelope panel 46. In a second folding step, front envelope panel 46 is folded along first transverse parting line 43 to a superposed position on rear envelope panel 44 and the lateral edges of the envelope panels are bonded by adhesive lines 36 which have been previously applied, thereby forming the envelope panel. As shown in FIG. 2A, the folded elements assume an accordion or Z-folded configuration. As illustrated in FIG. 2B, one or more spots of releasable adhesive 60 are applied to card 32, and a third folding step along first transverse parting line 34 brings the finished envelope and reply device into a superposed position on card 32 where the exposed portion of front envelope panel 46 contacts the releasable adhesive 60 to secure the assembly during transmission in the mails.

The final folded configuration of the direct mail article of the invention is further illustrated in FIG. 3 where the front and rear envelope panels 46, 44 are partially cut away. As shown in the preferred embodiment of FIG. 3, the envelope has been personalized with the addressee information, leaving the entire front and rear surfaces of the oversized card 32 for use as printed fields as desired.

The invention can be economically manufactured on high speed folding equipment that is readily adapted to this purpose by those skilled in the art. Longitudinal, or lateral edge segments 24, 41 and 51 can be trimmed using well-known techniques for die-cutting and removal prior to, or simultaneous with the folding. Likewise, application of remoistenable adhesive 47, permanent adhesive 36 and releasable adhesive 60, or wafer seal 61, at the respective positions and at appropriate times during the production process using existing techniques and equipment will be apparent to those familiar with the art.

In practicing the method of the invention, the pre-printed card stock in the form of a continuous web or sheet 10, comprises a card panel 30 terminating along a first transverse parting line 34, an envelope panel 40 joined to the card panel 30 along the first transverse parting line 34, and comprising a rear panel 44 joined to a front panel 46 along a first transverse fold line 43 and a flap 48 joined to the front panel 46 along a second transverse fold line 45, and a reply device panel 50 comprising reply device 52 joined to flap 48 along second transverse parting line 49 and terminating along third transverse line 22, and the method comprises the steps of:

(a) cutting and removing at least one longitudinal edge 51 of the reply device panel 50 so that reply device 52 is narrower than the envelope panel 40, (b) applying adhesive 36 to the longitudinal edges of at least one of the envelope rear panel 44 and front panel 46, (c) perforating the first and second transverse parting lines 43, 49, (d) folding the reply device 52 and envelope flap 48 along the second transverse fold line 45 to contact the envelope front panel 46 on the side away from adhesive 36, (e) folding the envelope front panel 46 onto the envelope rear panel 44 along the first transverse fold line 43 thereby bonding the longitudinal edges and forming the envelope pocket, (f) folding the envelope along the first transverse parting line 34 to a superposed position on the card 32, and (g) applying releasable adhesive sealing means 60 to temporarily bond the envelope and reply device to the card panel.

As will be appreciated by one skilled in the art, in the practice of the method of the invention, the order of the steps can be modified to achieve the same result. As will be apparent from the discussion of the preferred embodiments of the direct mail article, the method of the invention can also include the additional step of cutting and removing the longitudinal or lateral opposite edges of the envelope panel 24 so that the finished envelope is narrower, and lies inside the edges of the card. It is also desirable that the third transverse line forming the outer transverse, or free edge of the reply device lies inside of the envelope so that releasable adhesive 60 can be positioned to contact only the card and the front panel of the envelope in the superposed position.

Figure 4:
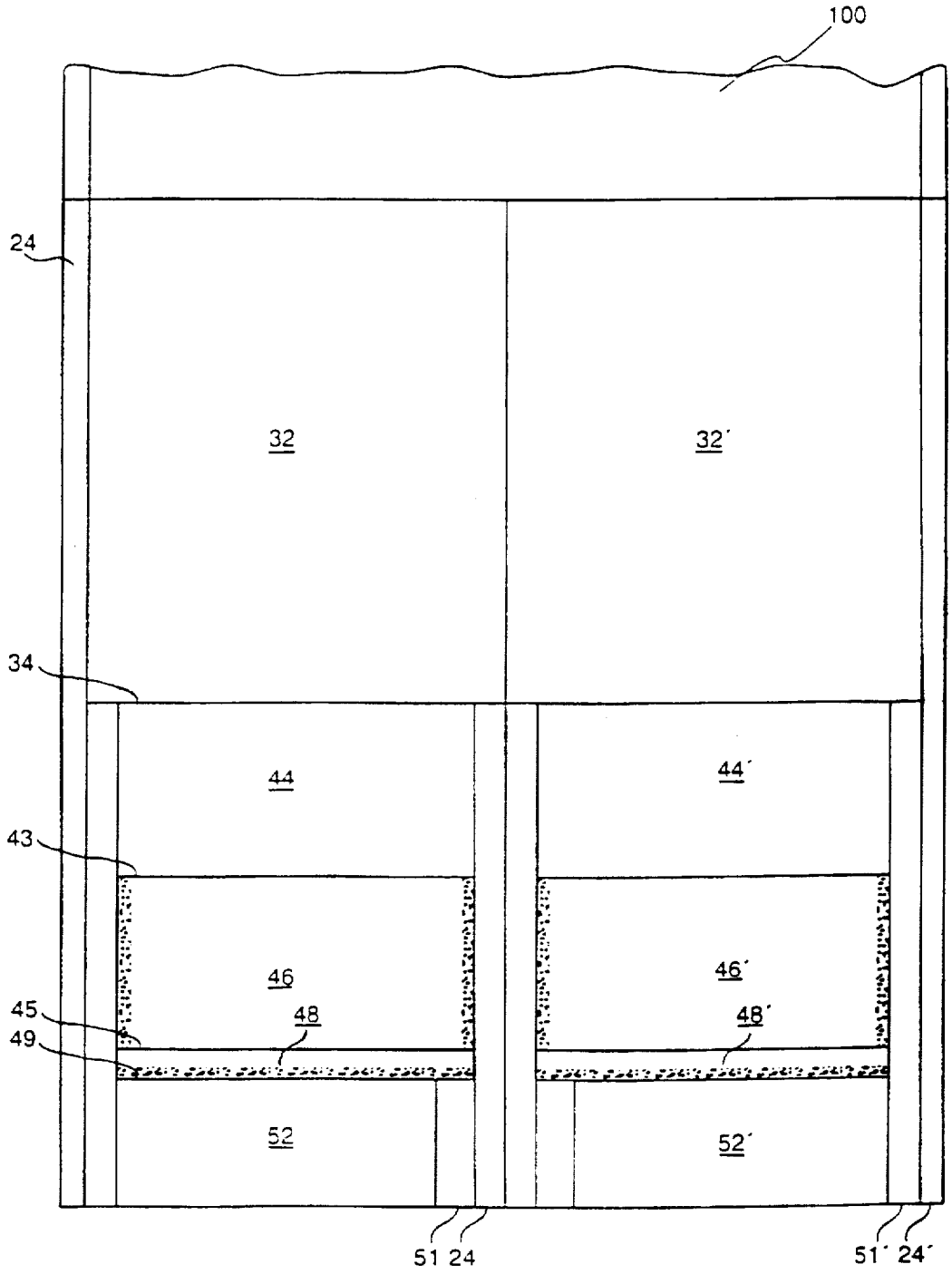
FIG. 4 is a plan view similar to that shown in FIG. 1 illustrating the embodiment of the invention of a pair of articles laid out in side-by-side relation.

As shown in FIG. 4, the method of the invention can be practiced in essentially the same way to simultaneously produce two, or more, direct mail articles of the invention. In the embodiment illustrated in FIG. 4, the continuous web, or sheet, 100 is approximately twice the width sheet 10 of FIG. 1. As also illustrated in FIG. 4, the elements are substantially identical to those described above and the same reference numbers are used to describe like elements. The practice of the invention using two or more layouts in a side-by-side array will be understood by those skilled in the art to make a more efficient use of standard card stock sizes and to more fully utilize the capacity of existing production equipment. In this embodiment, the layout is in the form of a mirror image so that the die-cutting and removal of longitudinal segments 24, 24', 41, 41' and 51, 51' can be accomplished in a single step. In all other respects, the steps of the method are substantially the same as those described above in the connection with the embodiment of FIGS. 1–3.

Other modifications to the specific layout of the invention will be apparent to those familiar with the art. For example, as illustrated in FIGS. 5 and 6, the reply device can be separably attached between the card and the envelope with relatively minor modifications to the trimming and sequence of folding of the respective finished panels.

Figure 5:
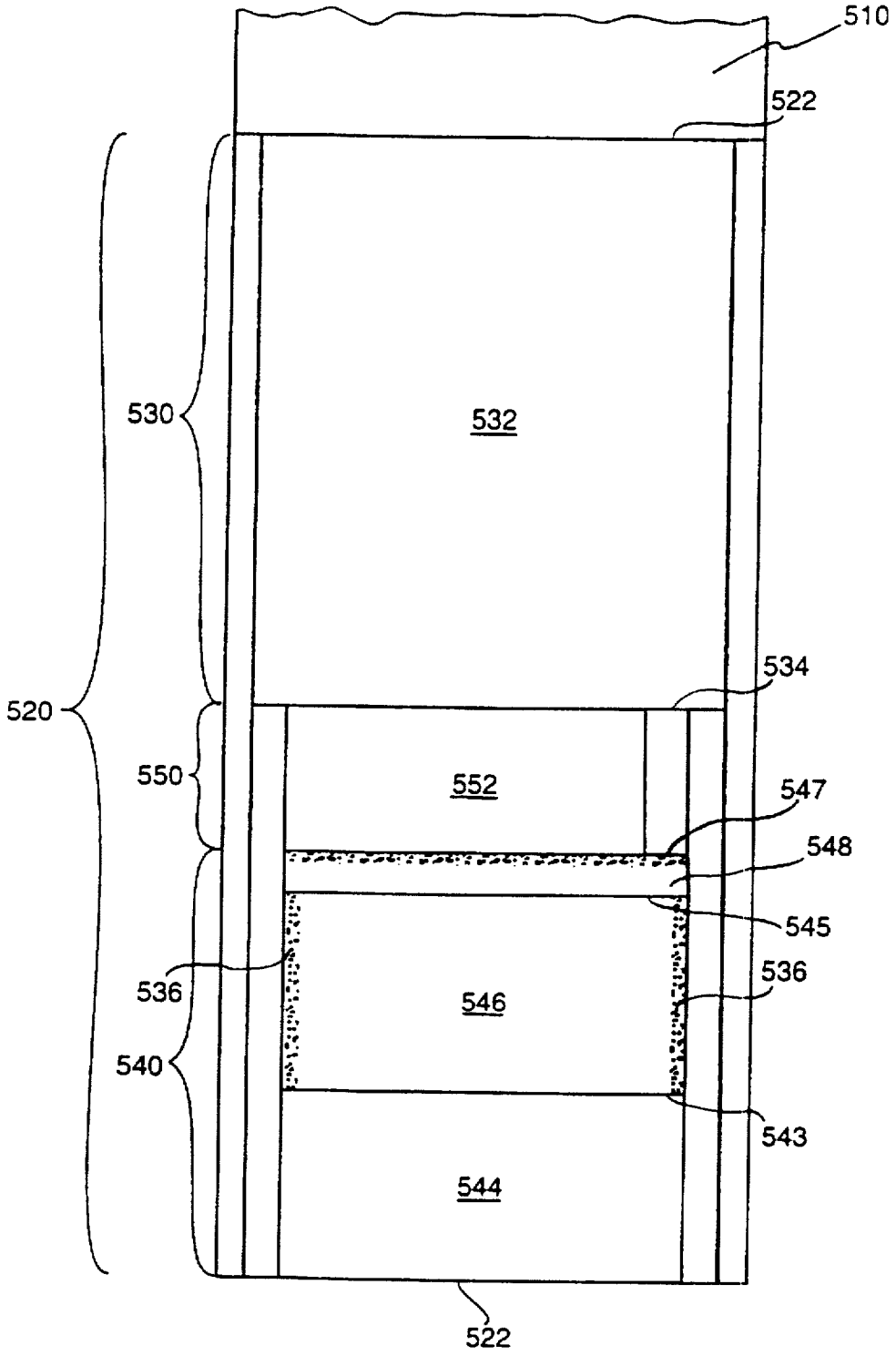
FIG. 5 is a plan view of a portion of a sheet or web illustrating the layout of another embodiment of the invention in an unfolded form.

As shown in the embodiment of FIG. 5, in which like numerals are used to refer to elements that correspond to those described above, the reply device panel 550, is positioned between card panel 530 and envelope panel 540. Reply device 552 is separably joined to card 532 along first transverse parting line 534 and is separably joined to envelope flap 547 along second transverse parting line 549.

Figure 6A:
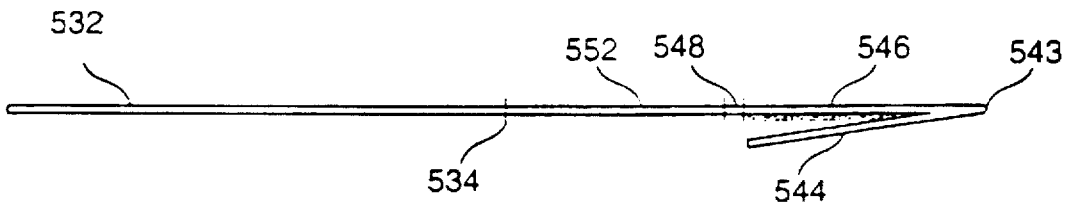
FIGS. 6A–6C are schematic side views of the partially folded panels shown in FIG. 5.
Figure 6B:
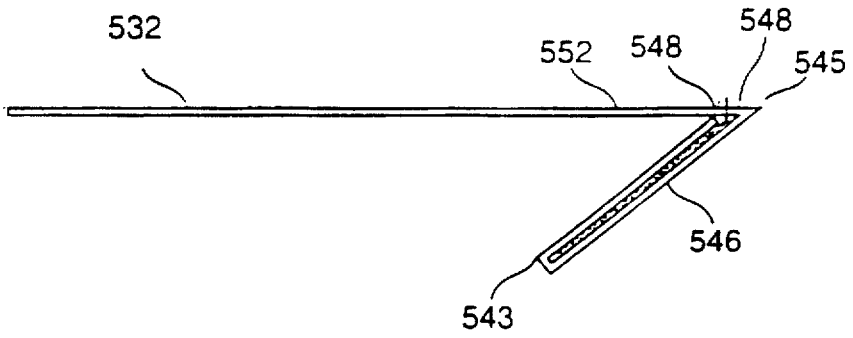
Figure 6C:
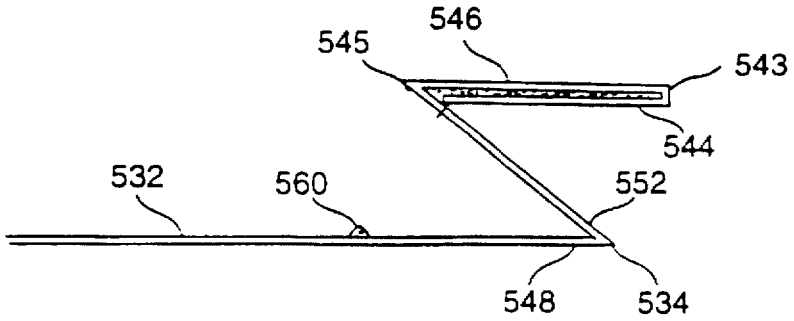

The sequence of folding the embodiment of the invention illustrated by FIG. 5 is shown schematically as partly completed in FIGS. 6A–6C. Envelope rear panel 544 is folded into superposed bonding relationship with front panel 546 along first transverse fold line 543, as shown in FIG. 6A, to thereby form the envelope pocket. In a second folding step, illustrated in FIG. 6B, the front envelope panel is brought into superposed position with respect to the reply device 552 and flap 548 by folding along second transverse fold line 545. As illustrated in FIG. 6C, the reply device and envelope are then brought into superposed position on card 532 by folding along first transverse parting line 534, where they are held in place by, for example, one or more spots of releasable adhesive 560.

In a further embodiment of the method of the invention, a plurality of reply devices, each separably joined to another and fan-folded into overlying and superposed position between the card and preformed envelope can be incorporated into the structure. The one, or more than one reply device can be printed and configured to serve as a separate reply postcard that can be deposited for mailing without insertion into the envelope.

Figure 7:
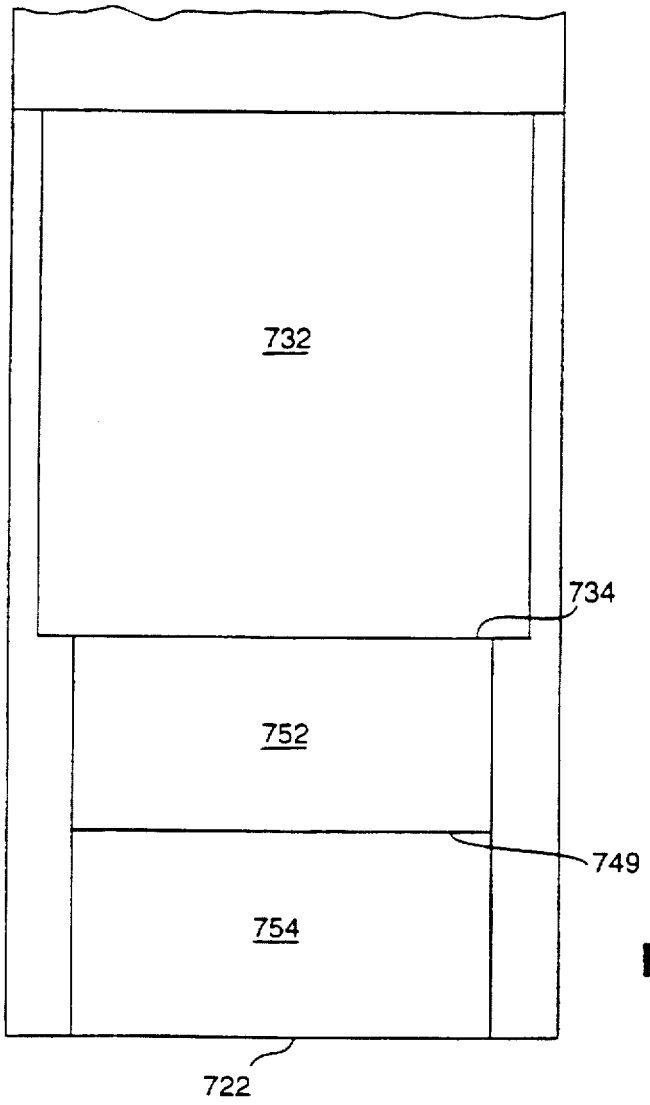
FIG. 7 is a plan view of a portion of a sheet or web illustrating the layout of another embodiment of the invention in unfolded form.
Figure 8A:
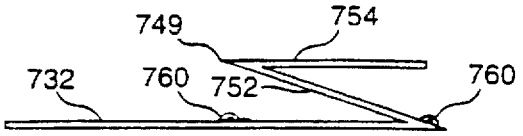
FIGS. 8A and 8B are schematic side views illustrating alternative methods of folding the article of FIG. 7.
Figure 8B:
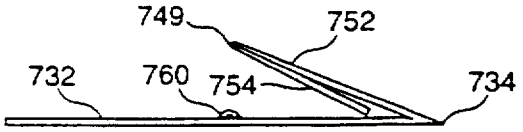

Another embodiment of the invention is illustrated in FIG. 7 in which like numerals are used to refer to elements that correspond to those described above. A reply panel 750 is separably attached to card panel 530 along first transverse parting line 734, which can be perforated. The reply panel 750 is comprised of at least one reply device 752, which can be a business reply postcard, and a second device 754, which can be a business reply postcard or an advertising device, that are joined along second transverse parting line 749. The elements 752 and 754 can be accordion folded or otherwise folded as illustrated in FIGS. 8A and 8B into a superposed position on card 732, and secured for mailing by releasable adhesive means, such as by one or more spots of adhesive 760. As in prior embodiments, the one or more reply devices can be personalized, as can the card 732 and the optional advertising device 754.

Other modifications and embodiments will be apparent to those familiar with the art, particularly as to the sequence of the layout of the elements and the folding steps, and the scope of the invention is to be defined by the claims which follow.

I claim:

1. A direct mail article produced from mailable card stock for transmission via the United States Postal Service without an outer wrapper comprising:

a first rectangular card panel having a height and a width approximating the size of a magazine cover, a lateral edge of which card panel defines a first transverse parting line corresponding to the width of said first card panel, a second card panel defined by at least a portion of said first transverse parting line and a second transverse parting line, and by longitudinal edges extending between said parting lines, the width of said second card panel not exceeding the width of the first card panel, a third card panel defined by said second transverse parting line and a third transverse line, and by longitudinal edges extending between said parting lines, the width of said third card panel not exceeding the width of the first card panel, and the distance between the first and second transverse parting lines and the distance between the second transverse parting line and the third transverse line are each less than about one-half the height of the first card panel, where the third card panel is separably joined to the second card panel along the second transverse parting line and the second and third card panels are folded along said first and second transverse parting lines to superpose said second and said third card panels on said first card panel, and releasable bonding means securing said second card panel and said third card panel in superposed position on said first card panel, whereby said direct mail article can be transmitted through the mail without folding said first card panel and without an envelope or other outer wrapper.

2. The direct mail article of claim 1 where the third card panel is a reply device.

3. The direct mail article of claim 2 where the reply device is a pre-paid business reply postcard.

4. The direct mail article of claim 1 where the releasable bonding means is adhesive.

5. The direct mail article of claim 1 where the releasable bonding means is a wafer seal.

6. The direct mail article of claim 1 where the area of the first card panel is at least about twice the area of the second card panel.

7. The direct mail article of claim 6 where the dimensions of the first card panel are at least about 7 inches by about 9 inches.

8. the direct mail article of claim 1 where the first and second transverse parting lines are perforated.

9. The direct mail article of claim 1 where the width of the second card panel is less than the width of the first card panel.

10. The direct mail article of claim 9 where the width of the second and third card panels is the same.

11. The direct mail article of claim 10 where the longitudinal edges of the second card panel extend from inside the ends of the first parting line.

* * * * *